US009446527B1

(12) United States Patent
Brainard

(10) Patent No.: US 9,446,527 B1
(45) Date of Patent: Sep. 20, 2016

(54) PULL-TYPE CUTTERS

(71) Applicant: Paul Brainard, La Verne, CA (US)

(72) Inventor: Paul Brainard, La Verne, CA (US)

( * ) Notice: Subject to any disclaimer, the term of this patent is extended or adjusted under 35 U.S.C. 154(b) by 0 days.

(21) Appl. No.: 14/881,086

(22) Filed: Oct. 12, 2015

Related U.S. Application Data

(60) Provisional application No. 62/202,154, filed on Aug. 6, 2015.

(51) Int. Cl.

| | |
|---|---|
| ***B26B 13/26*** | (2006.01) |
| ***B25G 1/06*** | (2006.01) |
| ***B25G 1/10*** | (2006.01) |
| ***B26B 27/00*** | (2006.01) |

(52) U.S. Cl.
CPC ..... *B26B 13/26* (2013.01); *B25G 1/06* (2013.01); *B25G 1/102* (2013.01); *B26B 27/00* (2013.01)

(58) Field of Classification Search
CPC ..... B26B 27/00; B26B 13/26; B25G 1/06; B25G 1/102
USPC ..... 30/238, 235, 244–251, 253, 257–259
See application file for complete search history.

(56) References Cited

U.S. PATENT DOCUMENTS

| | | | | | |
|---|---|---|---|---|---|
| 97,973 | A * | 12/1869 | Shehan | A01G 3/025 | 30/246 |
| 103,873 | A * | 6/1870 | Grover | A01G 3/025 | 30/250 |
| 124,455 | A * | 3/1872 | Snell | A01G 3/025 | 30/251 |
| 126,888 | A * | 5/1872 | Keethler | A01G 3/025 | 30/251 |
| 146,942 | A * | 1/1874 | Nunan | A01G 3/025 | 30/251 |
| 187,064 | A * | 2/1877 | Stroop | D05B 37/04 | 30/249 |
| 313,259 | A * | 3/1885 | Upton | A01G 3/025 | 30/245 |
| 334,582 | A * | 1/1886 | Haas | A01G 3/025 | 30/245 |
| 354,363 | A | 12/1886 | Titus | | |
| 361,911 | A | 4/1887 | Weston | | |
| 397,698 | A * | 2/1889 | Cooper | B23D 29/023 | 30/250 |
| 453,669 | A * | 6/1891 | Scheewe | B23D 29/023 | 30/250 |
| 460,705 | A * | 10/1891 | Hansen | A01G 3/025 | 30/238 |
| 476,114 | A | 5/1892 | Andrews | | |
| 502,809 | A * | 8/1893 | Caspian | A01G 3/025 | 30/238 |
| 512,451 | A * | 1/1894 | Shultz | B23D 29/023 | 30/250 |
| 677,419 | A | 7/1901 | Lott | | |
| 692,673 | A * | 2/1902 | Joseph | A01G 3/025 | 30/251 |
| 709,478 | A | 9/1902 | Fortney | | |
| 777,366 | A * | 12/1904 | Bergmark | A01G 3/025 | 30/251 |
| 838,298 | A | 12/1906 | Briggs | | |

(Continued)

FOREIGN PATENT DOCUMENTS

GB 2220606 A * 1/1992

*Primary Examiner* — Jason Daniel Prone
(74) *Attorney, Agent, or Firm* — Loza & Loza, LLP; Razmig Messerian

(57) ABSTRACT

One feature pertains to cutters that include a top lever having a first end that includes a first handle, and a bottom lever having a first end that includes a second handle. The bottom lever includes a bottom edge. The cutters also include a cutting lever having a top edge, a first member rotatably coupling the cutting lever to the bottom lever, and a second member coupling the top lever to the cutting lever. The top lever may move the second member when the first handle is moved relative to the second handle. Moving the second member causes the cutting lever to rotate about the first member to move the top edge toward or away from the bottom edge. The top edge and the bottom edge extend from the first member in a substantially same direction as the first and second handles.

20 Claims, 19 Drawing Sheets

(56) References Cited

U.S. PATENT DOCUMENTS 907,065 A * 12/1908 Litzelman ..... A01G 3/025 30/249
975,059 A * 11/1910 Meissner ..... A01G 3/025 30/238
985,048 A * 2/1911 Meissner ..... A01G 3/025 30/238
996,674 A * 7/1911 Randle et al. ..... A01G 3/025 30/238
1,009,009 A 11/1911 Bachand et al.
1,447,483 A * 3/1923 Pazos ..... B23D 29/023 30/250
1,507,529 A * 9/1924 Sundman ..... A01G 3/0475 30/248
1,666,832 A * 4/1928 Perl et al. ..... B23D 29/026 30/250
1,700,174 A * 1/1929 McMillan ..... B21F 11/00 30/251
2,326,178 A * 8/1943 Seeberger ..... B26B 13/00 30/250
2,391,598 A * 12/1945 Serdich ..... B23D 29/026 30/251
2,568,234 A 9/1951 Haufrect
2,665,755 A * 1/1954 McCoy ..... B23D 17/08 30/251
2,808,647 A * 10/1957 Ikeuchi ..... B23D 29/026 30/253
2,897,591 A 8/1959 Nastasi et al.
2,915,821 A 12/1959 Partin
3,090,121 A * 5/1963 Chonka ..... B23D 29/026 30/251
3,279,063 A * 10/1966 Chalup ..... A01G 3/06 30/253
3,333,607 A * 8/1967 Haraden ..... B65B 13/345 30/251
3,338,281 A * 8/1967 Davy ..... A47J 43/26 30/251
3,438,130 A * 4/1969 Ballard et al. ..... A01G 3/065 30/248
3,721,245 A * 3/1973 Campbell ..... A61B 17/3201 30/233
3,738,002 A * 6/1973 Coughtrie ..... B26B 13/26 30/258
4,058,894 A * 11/1977 Leturgez ..... B23D 17/08 30/251
4,285,344 A 8/1981 Marshall
4,507,864 A * 4/1985 Leibowitz ..... B26B 13/12 30/257
4,958,435 A * 9/1990 Grubbs ..... B26B 13/12 30/248
4,965,992 A * 10/1990 Jacobs ..... A01G 3/0255 30/251
5,074,046 A * 12/1991 Kolesky ..... B23D 29/026 30/250
5,092,049 A * 3/1992 Grubbs ..... B26B 13/12 30/248
5,193,277 A * 3/1993 Zmijewski ..... B26B 13/16 30/257
5,943,779 A * 8/1999 Antonio, Jr. ..... B26B 13/00 30/248
6,079,107 A 6/2000 Horvath
6,754,961 B2 * 6/2004 Brockhage ..... B26B 13/26 30/251
6,813,836 B2 * 11/2004 Graca ..... B23D 29/026 30/251
7,690,118 B2 * 4/2010 Yamakado ..... B23D 29/023 30/251
2003/0167640 A1 * 9/2003 Heck ..... A01G 3/02 30/253
2005/0283981 A1 12/2005 Yizhar
2010/0236080 A1 * 9/2010 Huang ..... B26B 13/26 30/251

* cited by examiner

PULL-TYPE CUTTERS

CLAIM OF PRIORITY

The present application for patent claims priority to provisional application No. 62/202,154 entitled "Scissors" filed Aug. 6, 2015, the entire disclosure of which is hereby expressly incorporated by reference.

BACKGROUND

1. Field

Various features relate to cutters (e.g., scissors, shears, etc.), and more specifically, to hand-held pull-type cutters that allow a user to cut material while moving or pulling the cutters towards the user.

2. Background

Conventional hand-held cutters have cutting blades that extend out from a pivot member in a direction that is substantially opposite the cutters' handle arms used to operate the conventional cutters. A user operating such conventional cutters manually squeezes together and pulls apart the handle arms, which in turn moves the cutting blades toward and away from one another about the pivot member, to cut material positioned between the cutting blades. Notably, the user must steadily push the cutters out away from themselves while operating the cutters to cut additional material.

One disadvantage of such a design is that the user's hands and/or the cutters' handle arms may interfere with the material as it is cut. This is particularly problematic when the material being cut is rigid, such as a sheet of metal, hard plastic, wood, or cardboard, since the rigid material cannot easily bend out of the way of the cutters' moving handle arms. Thus, attempting to cut a rigid material with such conventional cutters, especially when attempting to make angled cuts, may prove very difficult or unsafe due to the sharp edges of the material that have been cut which tend to brush against the user's hand.

Another disadvantage of the conventional hand-held cutters' design is that of safety. Since the cutting blades may have sharpened edges and/or sharpened points facing away from the user holding the cutters at their handle arms, walking or running about a space while holding such cutters may unintentionally hurt someone.

There is a need for improved designs for hand-held cutters that allow a user to make precision cuts efficiently and effectively. Such cutters should allow the user to cut material, even rigid material, without the cut material interfering with the operation of the cutters itself. Moreover, the cutters should feature improved safety over conventional designs.

SUMMARY OF INVENTION

One feature provides an apparatus comprising a top lever having a first end that includes a first handle, a bottom lever having a first end that includes a second handle, the bottom lever including a bottom edge, a cutting lever having a top edge, at least one of the bottom edge and/or the top edge being sharp, a first member rotatably coupling the cutting lever to the bottom lever, and a second member coupling the top lever to the cutting lever, the top lever adapted to move the second member when the first handle is moved relative to the second handle, moving the second member causes the cutting lever to rotate about the first member to move the top edge toward or away from the bottom edge, and wherein the top edge and the bottom edge extend from the first member in a same direction as the first and second handles. According to one aspect, the top lever is adapted to move the second member within an opening located in the bottom lever. According to another aspect, the first member is positioned closer to the first and second handles than the second member.

According to one aspect, raising the top lever up and away from the bottom lever causes the second member to move up within an opening in a same direction as the top lever, the opening located in the bottom lever. According to another aspect, the apparatus further comprises a third member rotatably coupling the top lever to the bottom lever, the third member positioned further away from the first and second handles than both the first member and the second member. According to yet another aspect, the second member is positioned closer to the first and second handles than the first member.

According to one aspect, raising the top lever up and away from the bottom lever causes the second member to move down within an opening in an opposite direction as the top lever, the opening located in the bottom lever. According to another aspect, the apparatus further comprises a third member rotatably coupling the top lever to the bottom lever, the third member positioned closer to the first and second handles than both the first member and the second member. According to yet another aspect, at least one of the first and second members is at least one of a rod, screw, or a rivet.

According to one aspect, the top lever and the bottom lever are positioned adjacent to each other and when moved relative to each other move in different vertical planes. According to another aspect, the bottom lever is positioned in between the top lever and the cutting lever, and the second member passes through the bottom lever to couple the top lever to the cutting lever. According to yet another aspect, the second member passes through a slot of the bottom lever.

According to one aspect, the top lever and the bottom lever are positioned in a same vertical plane and are adapted to move relative to each other in the same vertical plane. According to another aspect, the apparatus further comprises a connecting piece, and a third member coupling the connecting piece to the top lever. According to yet another aspect, the connecting piece is fixedly coupled to the bottom lever or is part of the bottom lever, and the third member couples the connecting piece to the top lever at an opening of the top lever, the third member adapted to move about within the opening when the top lever is moved relative to the bottom lever.

According to one aspect, the connecting piece is adapted to rotate relative to top lever about the third member, and the apparatus further comprises a fourth member rotatably coupling the connecting piece to the bottom lever. According to another aspect, the apparatus further comprises a third member rotatably coupling the top lever to the bottom lever, and at least one of the top lever and/or the bottom lever includes a plurality of holes to which the third member is adapted to pass through to adjust leverage of the apparatus.

Another feature provides an apparatus comprising a top lever having a first handle, a bottom lever having a second handle, the bottom lever including a bottom edge, a cutting lever having a top edge, a means for coupling the cutting lever to the bottom lever, the means for coupling the cutting lever to the bottom lever adapted to allow the cutting lever to rotate relative to the bottom lever, the top edge and the bottom edge extending from the means for coupling the cutting lever to the bottom lever in a same direction as the first and second handles, and a means for coupling the top lever to the cutting lever, the top lever adapted to move the means for coupling the top lever to the cutting lever when the first handle is moved relative to the second handle, and wherein movement of the means for coupling the top lever to the cutting lever causes the cutting lever to rotate about the means for coupling the cutting lever to the bottom lever. According to one aspect, the bottom lever is positioned in between the top lever and the cutting lever, and the means for coupling the top lever to the cutting lever passes through a slot of the bottom lever to couple the top lever to the cutting lever.

Another feature provides an apparatus comprising a top lever having a first handle, a bottom lever having a second handle, the bottom lever including a bottom edge, a cutting lever having a top edge, at least one of the bottom edge and/or the top edge being sharp, the bottom lever positioned in between the top lever and the cutting lever, the bottom lever further positioned in between the top lever and the gear, a gear coupled to a toothed side of the cutting lever and adapted to rotate the cutting lever in a direction opposite of the gear, a first member rotatably coupling the cutting lever to the bottom lever, the top edge and the bottom edge extending from the first member in a same direction as the first and second handles, and a second member coupling the top lever to the gear such that rotating the top lever counterclockwise rotates the gear counterclockwise and rotating the top lever clockwise rotates the gear clockwise.

DETAILED DESCRIPTION

In the following description, specific details are given to provide a thorough understanding of the various embodiments of the disclosure. However, it will be understood by one of ordinary skill in the art that the embodiments may be practiced without these specific details. The word "exemplary" is used herein to mean "serving as an example, instance, or illustration." Any implementation or embodiment described herein as "exemplary" is not necessarily to be construed as preferred or advantageous over other embodiments of the disclosure. Likewise, the term "embodiments" does not require that all embodiments of the disclosure include the discussed feature, advantage or mode of operation. The term "cutters" as used herein includes shears and scissors. As used herein, the terms "coupled" and "coupling" mean that two components are directly or indirectly connected to each other. Thus, the two components may be directly touching each other or there may be an intermediary component between the two components that connects the two components together.

Overview

Various embodiments of hand-held cutters are described herein. The cutters are of a type that allows a user operator (herein "user") to cut material while pulling or otherwise moving the cutters towards the user. The material cut can vary widely but may include paper, cardboard, metal, wood, plastic, rubber, etc. Thus, sheets of paper, cardboard, wood, metal, rubber, and/or plastic may be cut safely and efficiently.

First Embodiment

Figure 1:
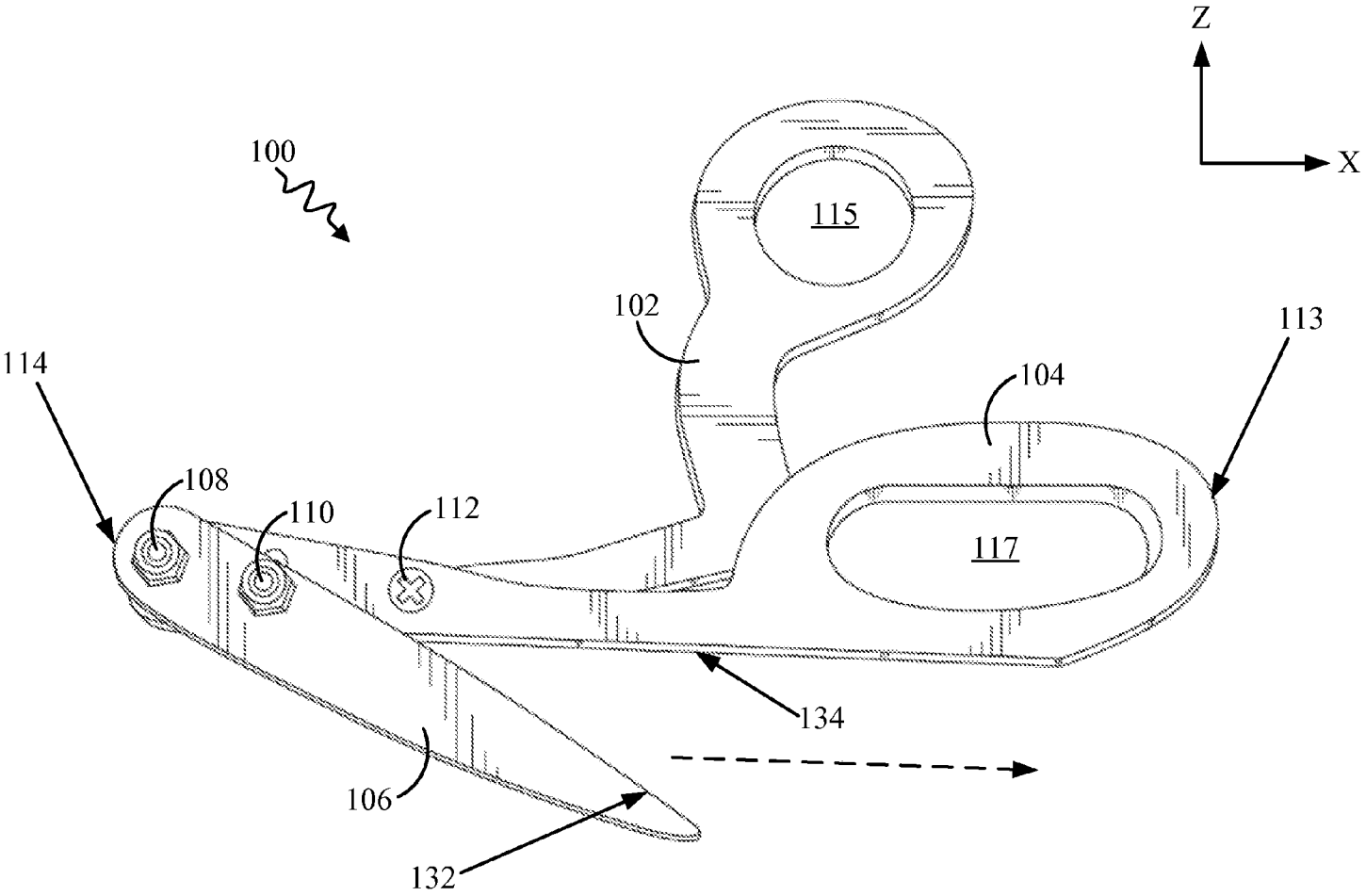
FIG. 1 illustrates a front-perspective view of a first embodiment of cutters in an open position.
Figure 2:
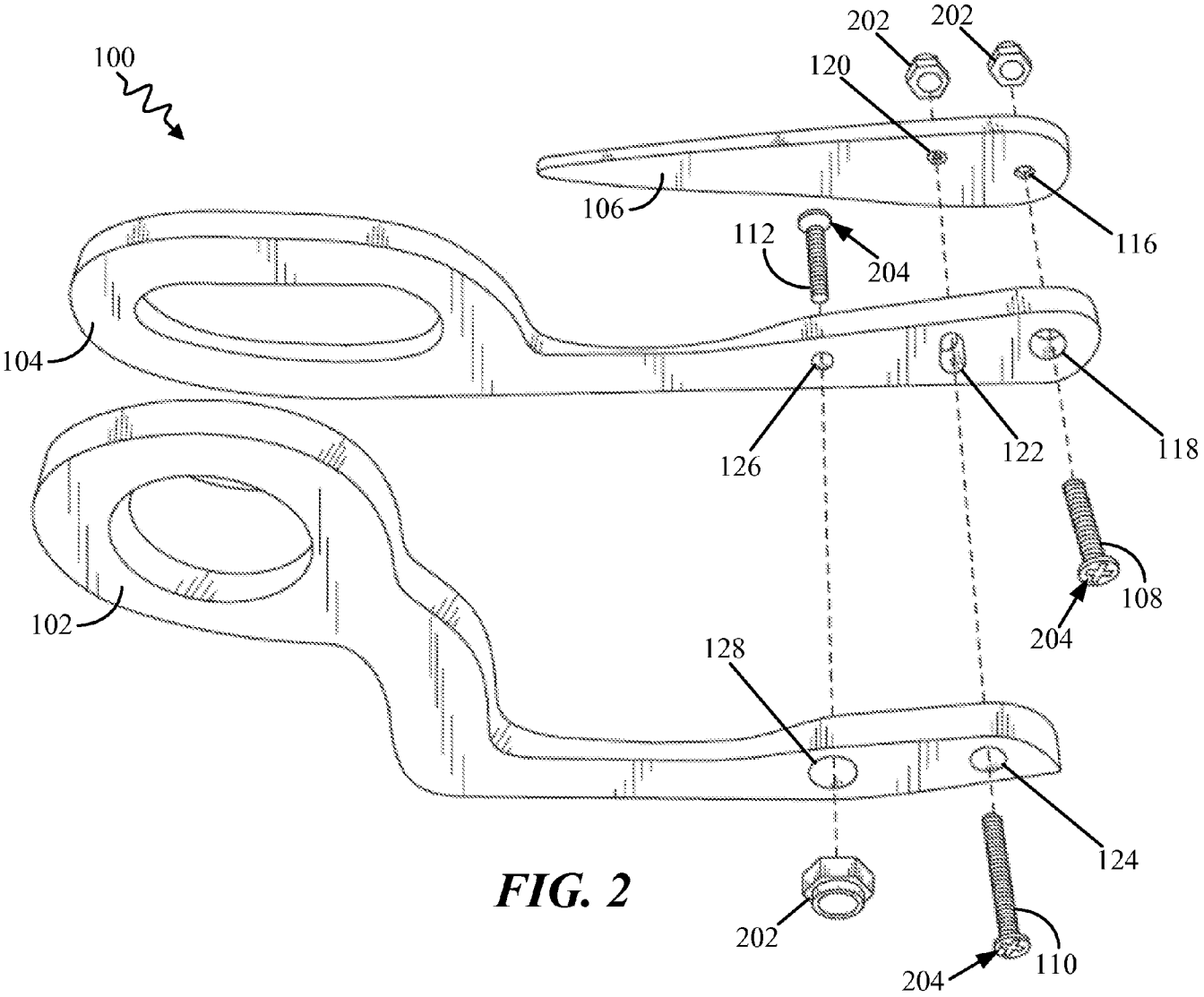
FIG. 2 illustrates a rear, exploded view of the first embodiment of the cutters.
Figure 3:
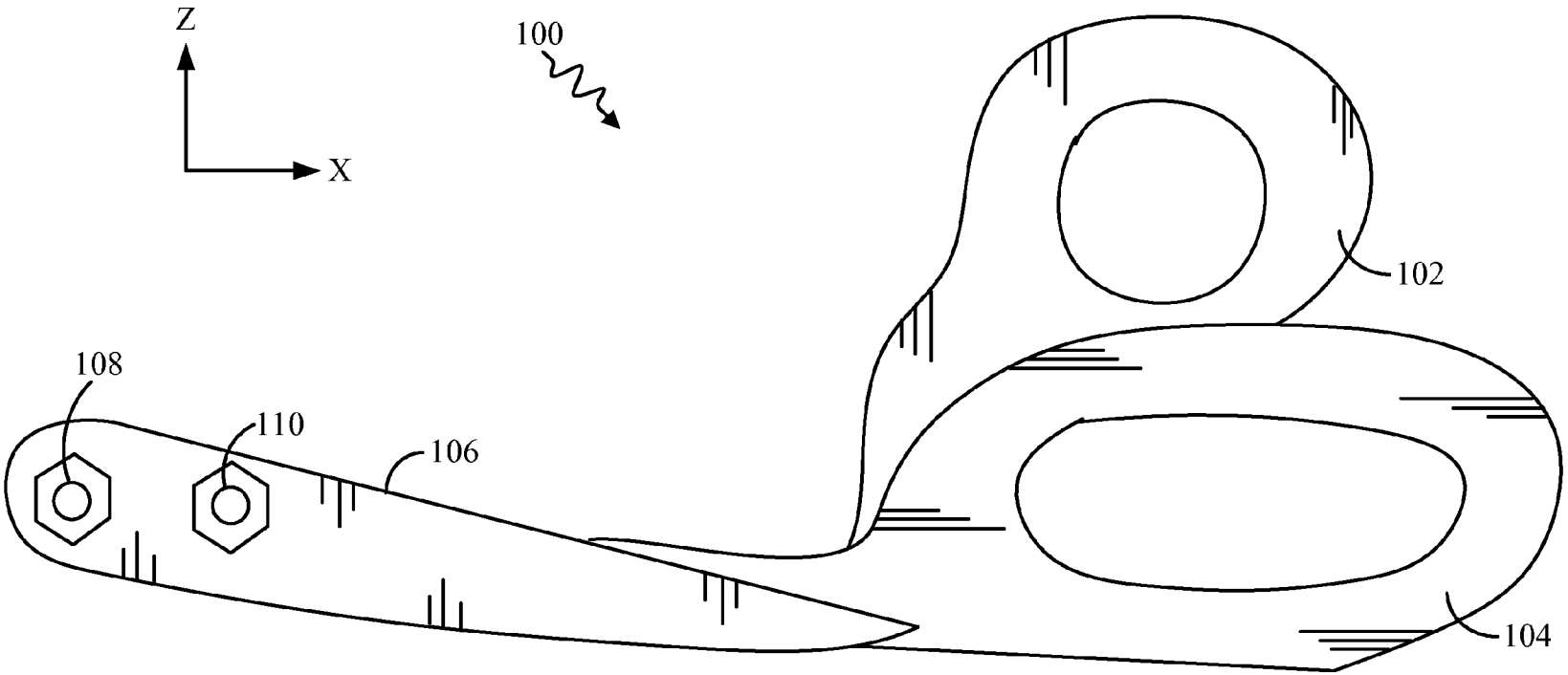
FIG. 3 illustrates a front-perspective view of the first embodiment of the cutters in a closed position.
Figure 4:
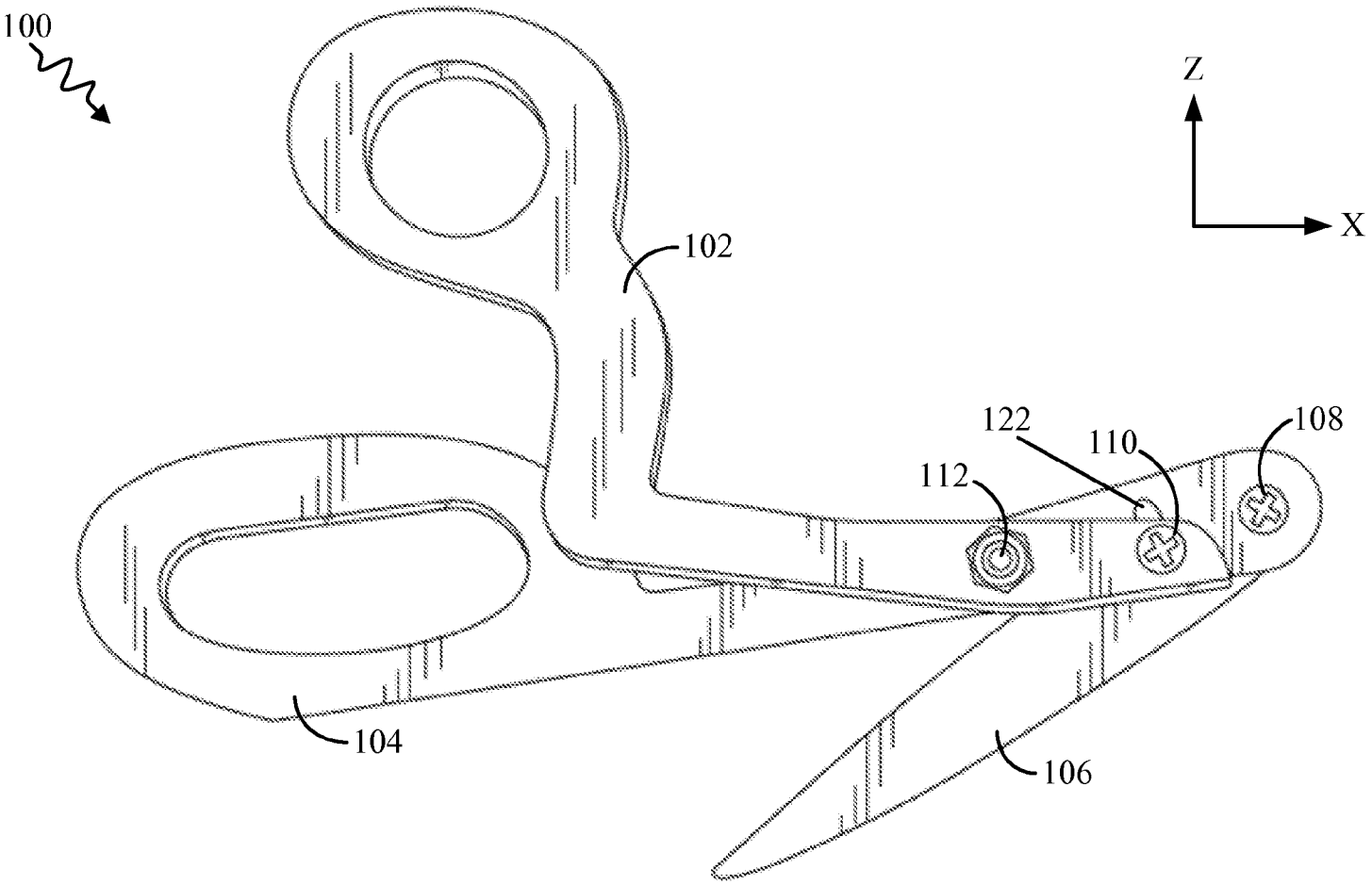
FIG. 4 illustrates a rear view of the first embodiment of the cutters.
Figure 5:
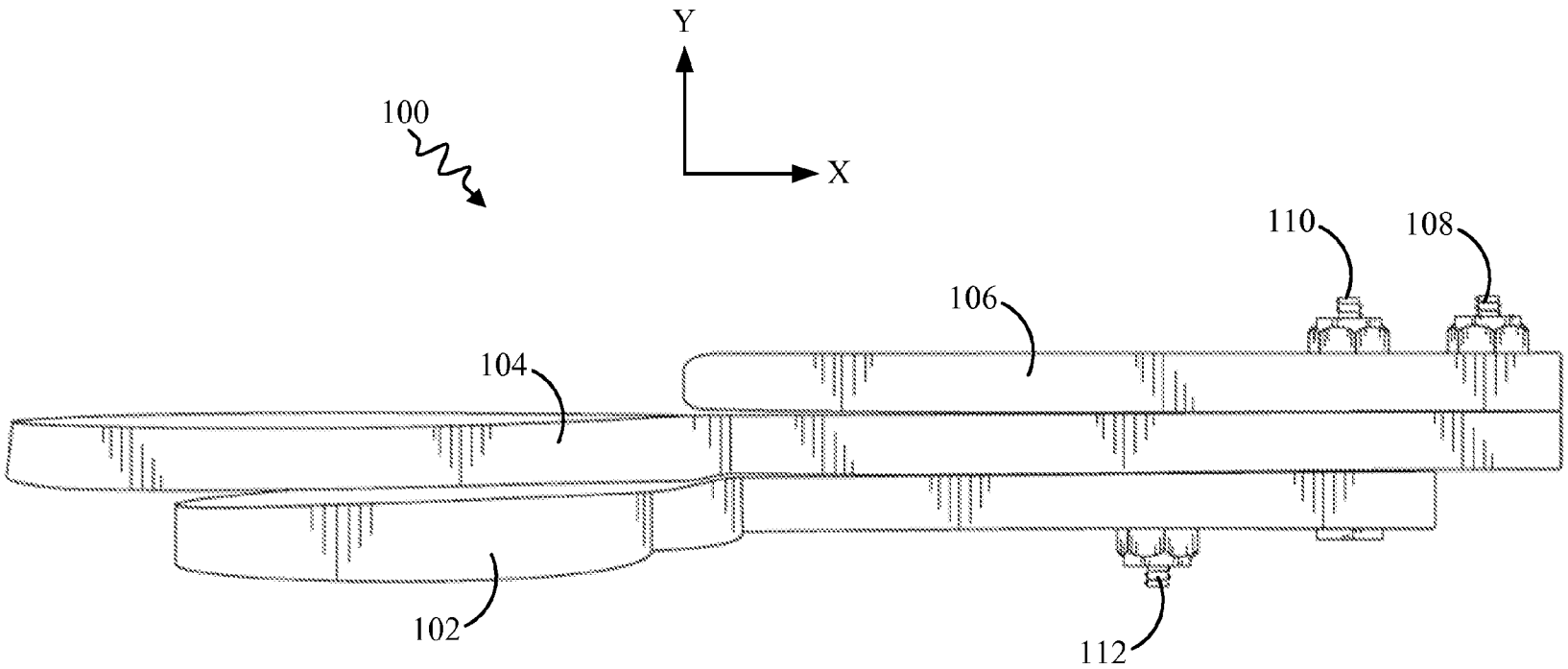
FIG. 5 illustrates a top view of the first embodiment of the cutters.

FIGS. 1-5 illustrate cutters 100 according to a first embodiment of the disclosure. Specifically, FIG. 1 illustrates a front-perspective view of the cutters 100 in an open position. FIG. 2 illustrates a rear, exploded view of the cutters 100. FIG. 3 illustrates a front-perspective view of the cutters 100 in a closed position. FIGS. 4 and 5 illustrate a rear view and a top view of the cutters 100, respectively. The cutters 100 may include a first lever 102 (e.g., "top lever"), a second lever 104 (e.g., "bottom lever"), a cutting lever 106, a first member 108 (e.g., "first pivot member" or "first pivot rod"), a second member 110 (e.g., "connector" or "second rod"), and a third member 112 (e.g., "third pivot member" or "third pivot rod"). The cutters 100 are operated by moving the top lever 102 and bottom lever 104 toward and away from each other. A user may do that by placing one or more fingers in the finger holes 115, 117 of the top and bottom levers 102, 104 found near a first end 113 of the cutters 100 and spreading their fingers apart and back together. When the top lever 102 and bottom lever 104 are pulled apart/away from one another the cutters 100 are herein referred to as being in the "open position." By contrast, when the top lever 102 and bottom lever 104 are moved towards each other the cutters 100 are herein referred to as being in the "closed position." Referring to FIG. 5, the cutters 100 may be considered "horizontally-oriented cutters" in that the top and bottom levers 102, 104 are positioned adjacent to one another in the same horizontal plane (e.g., parallel to X-Y plane).

Referring to FIGS. 1 and 2, the first pivot rod 108, located near a second end 114 of the cutters 100, passes through a hole 116 in the cutting lever 106 and another hole 118 in the bottom lever 104 to couple the bottom lever 104 and the cutting lever 106 together. The cutting lever 106 may rotate with respect to the bottom lever 104 about the first pivot rod 108. The connector 110 passes through a hole 120 in the cutting lever 106, through a first slot 122 (e.g., "first opening") located in the bottom lever 104, and through a hole 124 in the top lever 102. The connector 110 couples the top lever 102 and the cutting lever 106 together. The connector 110 moves about freely within the slot 122. The third pivot rod 112 passes through a hole 126 in the bottom lever 104 and also through a second slot 128 ("e.g., second opening") located in the top lever 102. The second slot 128 allows the third pivot rod 112 to move slightly within the top lever 102. In one embodiment, the first slot 122 and the second slot 128 may each have a curved shape like an arc having an inner side (e.g., intrados) that faces the first pivot rod 108. In other embodiments, the slots 122, 128 may have other shapes including, but not limited to, other elongated shapes. In one embodiment, the second slot 128 may be a circular hole.

In one embodiment, the members 108, 110, 112 have securing ends having diameters that are larger than the cross-sectional diameter of the members 108, 110, 112 in order to secure the members 108, 110, 112 within the one or more levers 102, 104, 106 and prevent them from falling out. According to one example, the securing ends may be fastening nuts 202. According to another example where the members are 108, 110, 112 are screws or bolts, one securing end of each member 108, 110, 112 may be a screw/bolt head 204 while the other end is a fastening nut 202. According to yet another example, the members 108, 110, 112 may be rivets.

Opening the cutters 100 by moving the top lever 102 up and away from the bottom lever 104 causes the top lever 102 to rotate (e.g., counterclockwise direction based on cutters' 100 orientation in FIG. 1) about the third pivot rod 112. It also causes the connector 110 to move down within the first slot 122, which in turn causes the cutting lever 106 to rotate (e.g., clockwise direction based on orientation in FIG. 1) about the first pivot rod 108. Rotating about the first pivot rod 108 in this fashion moves the cutting lever's top edge 132 away from the bottom lever's bottom edge 134. According to one embodiment, the cutting lever's top edge 132 and/or the bottom lever's bottom edge 134 is sharpened in order to cut material positioned in between the cutting lever 106 and the bottom lever 104.

Closing the cutters 100 by moving the top lever 102 back towards the bottom lever 104 causes the top lever 102 to rotate (e.g., clockwise direction based on cutters' 100 orientation in FIG. 1) about the third pivot rod 112. It also causes the connector 110 to move up within the first slot 122, which in turn causes the cutting lever 106 to rotate (e.g., counterclockwise direction based on orientation in FIG. 1) about the first pivot rod 108. Rotating about the first pivot rod 108 in this fashion moves the cutting lever's top edge 132 toward the bottom lever's bottom edge 134. As the cutters 100 are closed, material located between the cutting lever 106 and the bottom lever 104 may be cut if the cutting lever's top edge 132 and/or the bottom lever's bottom edge 134 is sharp. The cutters 100 may be pulled in the direction of the dashed arrow (see FIG. 1) while opening and closing the cutters 100 as described above in order to cut additional material. The cutters 100 may also be maneuvered in curved paths while being operated (i.e., opening and closing the cutters 100) to cut curved shapes of material. The material cut can vary widely but may include paper, cardboard, metal, wood, plastic, rubber, etc.

Second Embodiment

Figure 6:
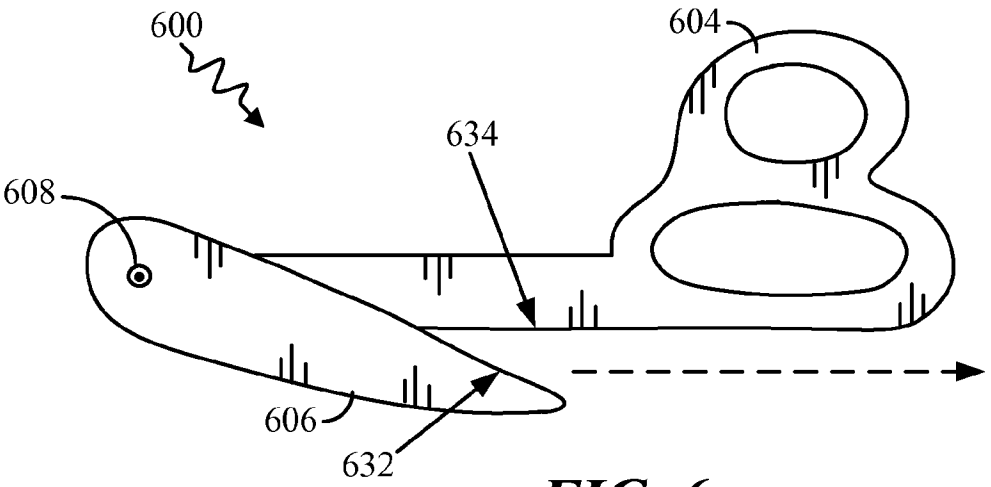
FIG. 6 illustrates a front view of a second embodiment of cutters.
Figure 7:
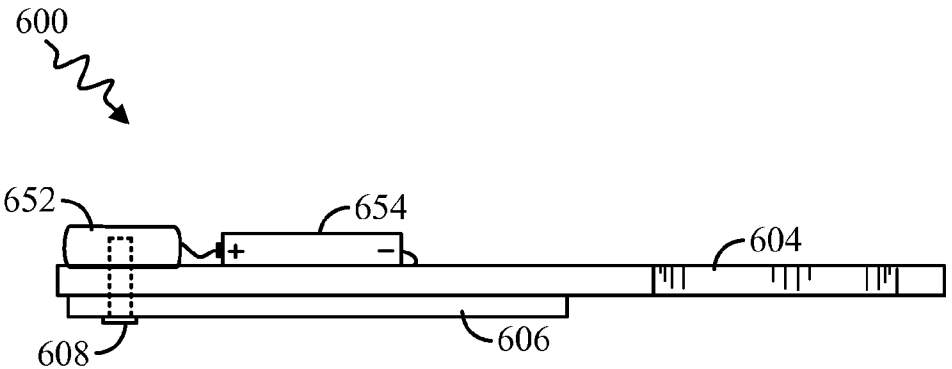
FIG. 7 illustrates a top view of the second embodiment of the cutters.

FIGS. 6 and 7 illustrate cutters 600 according to a second embodiment of the disclosure. Specifically FIG. 6 illustrates a front view of the cutters 600, and FIG. 7 illustrates a top view of the cutters 600. The cutters 600 shown in FIGS. 6 and 7 are similar to the cutters 100 shown in FIGS. 1-5 except that the cutters 600 of FIGS. 6 and 7 do not have a top lever 102, a connector 110, or a third pivot rod 112. Instead the cutters 600 have a bottom lever 604, a cutting lever 606, a first pivot member 608 (e.g., pivot rod), a motor 652, and a power source 654. The first pivot member 608 couples the cutting lever 606 to the motor 652. The motor 652 is coupled to the power source 654 (e.g., battery).

When the motor 652 is activated (e.g., via a switch (not shown)) it turns the first pivot member 608 back and forth (i.e., clockwise and counterclockwise), which in turn moves the cutting lever 606 back and forth (i.e., rotates the cutting lever clockwise and counterclockwise) relative to the bottom lever's bottom edge 634. If the cutting lever's top edge 632 and/or the bottom lever's bottom edge 634 are sharpened then material positioned in between the cutting lever 606 and the bottom lever 604 may be cut. The cutters 600 may be pulled in the direction of the dashed arrow (see FIG. 6) while being operated in order to cut more material. The cutters 600 may also be maneuvered in curved paths while operating the cutters 600 (i.e., motor 652 activated) to cut curved shapes of material.

Third Embodiment

Figure 8:
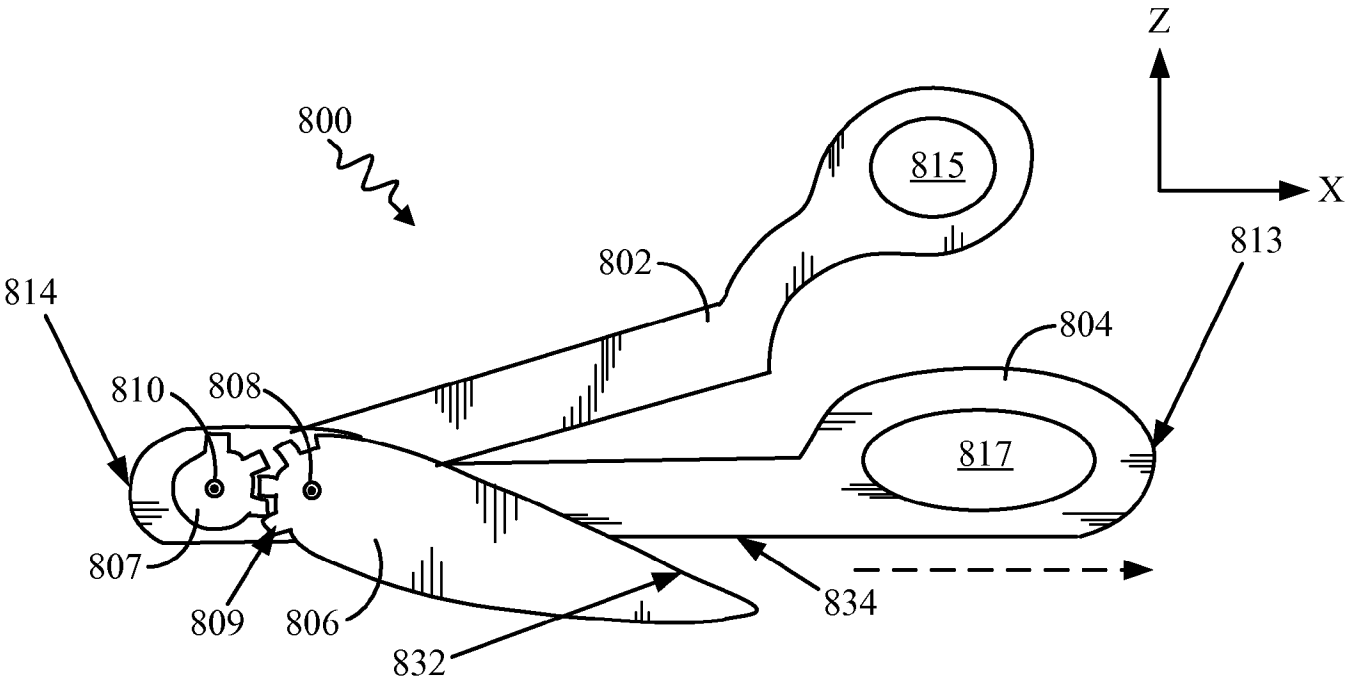
FIG. 8 illustrates a front view of a third embodiment of the cutters.
Figure 9:
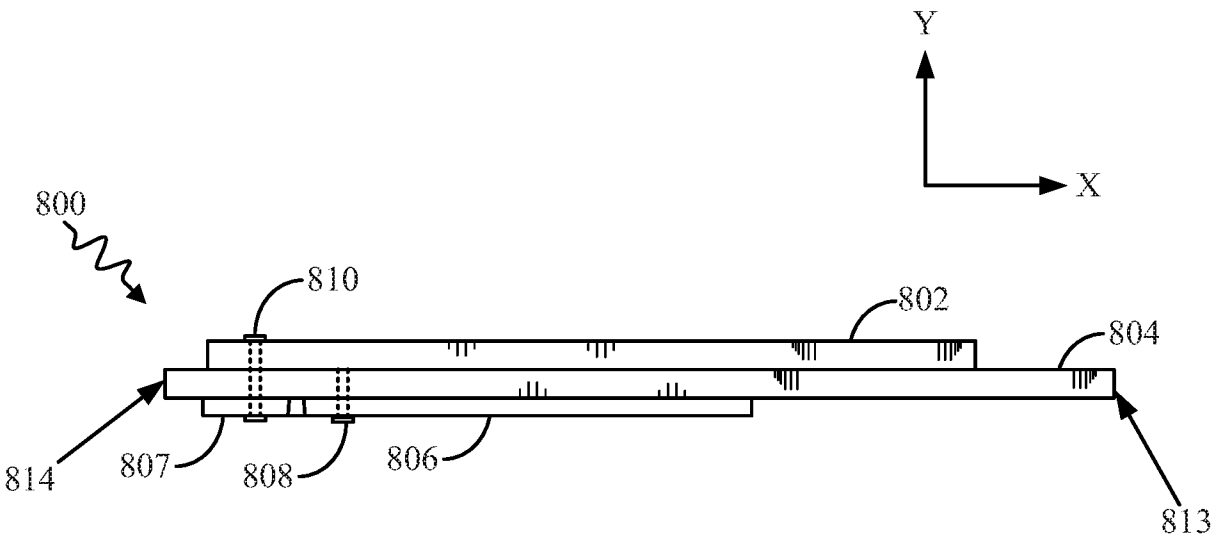
FIG. 9 illustrates a top view of the third embodiment of the cutters.

FIGS. 8 and 9 illustrate cutters 800 according to a third embodiment of the disclosure. Specifically FIG. 8 illustrates a front view of the cutters 800, and FIG. 9 illustrates a top view of the cutters 800. The cutters 800 may include a first lever 802 (e.g., "top lever"), a second lever 804 (e.g., "bottom lever"), a cutting lever 806, a gear 807, a first pivot member 808 (e.g., "first member" or "first pivot rod"), and a second pivot member 810 (e.g., "second member" or "second pivot rod"). The cutters 800 are operated by moving the top lever 802 and bottom lever 804 toward and away from each other. A user may do that by placing one or more fingers in the finger holes 815, 817 of the top and bottom levers 802, 804 found near a first end 813 of the cutters 800 and spreading their fingers apart and back together. Referring to FIG. 9, the cutters 800 are horizontally-oriented cutters because the top and bottom levers 802, 804 are positioned adjacent to one another in the same horizontal plane (e.g., parallel to X-Y plane).

The second pivot rod 810, located near a second end 814 of the cutters 800, passes through a hole in the gear 807, a hole in the bottom lever 804, and another hole in the top lever 802, thereby coupling the top lever 802 and the gear 807 together. Thus, if the top lever 802 rotates about the second pivot rod 810 so too does the gear 807 in the same direction. The gear 807 mates with a toothed side 809 of the cutting lever 806, and as the gear 807 rotates in one direction the cutting lever 806 also rotates but in an opposite direction to the gear 807. The first pivot rod 808 passes through a hole in the cutting lever 806 and a hole in the bottom lever 804 thereby coupling the bottom lever and the cutting lever together and allowing the cutting lever 806 to rotate relative to the bottom lever 804 about the first pivot rod 808.

In one embodiment, the pivot rods 808, 810 have securing ends having diameters that are larger than the cross-sectional diameter of the pivot rods 808, 810 in order to secure the pivot rods 808, 810 within the one or more levers 802, 804, 806 and/or gear 807 and prevent them from falling out. According to one example, the securing ends may be nuts. According to another example where the pivot rods are 808, 810 are screws or bolts, one securing end of each pivot rod 808, 810 may be a screw/bolt head while the other end is a fastening nut. According to yet another example, the pivot rods 108, 110, 112 may be rivets.

Opening the cutters 800 by moving the top lever 802 up and away from the bottom lever 804 causes the gear 807 to rotate (e.g., counterclockwise direction based on cutters' 800 orientation in FIG. 8) about the second pivot rod 810. The rotating gear 807 in turn rotates the cutting lever 806 about the first pivot rod 808 in the opposite direction (e.g., clockwise direction) causing the cutting lever 806 to move away from the bottom lever 804.

Closing the cutters 800 by moving the top lever 802 down and toward the bottom lever 804 causes the gear 807 to rotate (e.g., clockwise direction based on cutters' 800 orientation in FIG. 8) about the second pivot rod 810. The rotating gear 807 in turn rotates the cutting lever 806 about the first pivot rod 808 in the opposite direction (e.g., counterclockwise direction) causing the cutting lever 806, and its top edge 832, to move toward the bottom lever's bottom edge 834. As the cutters 800 are closed, material located between the cutting lever 806 and the bottom lever 804 may be cut if the cutting lever's top edge 832 and/or the bottom lever's bottom edge 834 is sharp. The cutters 800 may be pulled in the direction of the dashed arrow (see FIG. 8) while opening and closing the cutters 800 as described above in order to cut additional material. The cutters 800 may also be maneuvered in curved paths while being operated (i.e., opening and closing the cutters 100) to cut curved shapes of material. The material cut can vary widely but may include paper, cardboard, metal, wood, plastic, rubber, etc.

Fourth Embodiment

Figure 10:
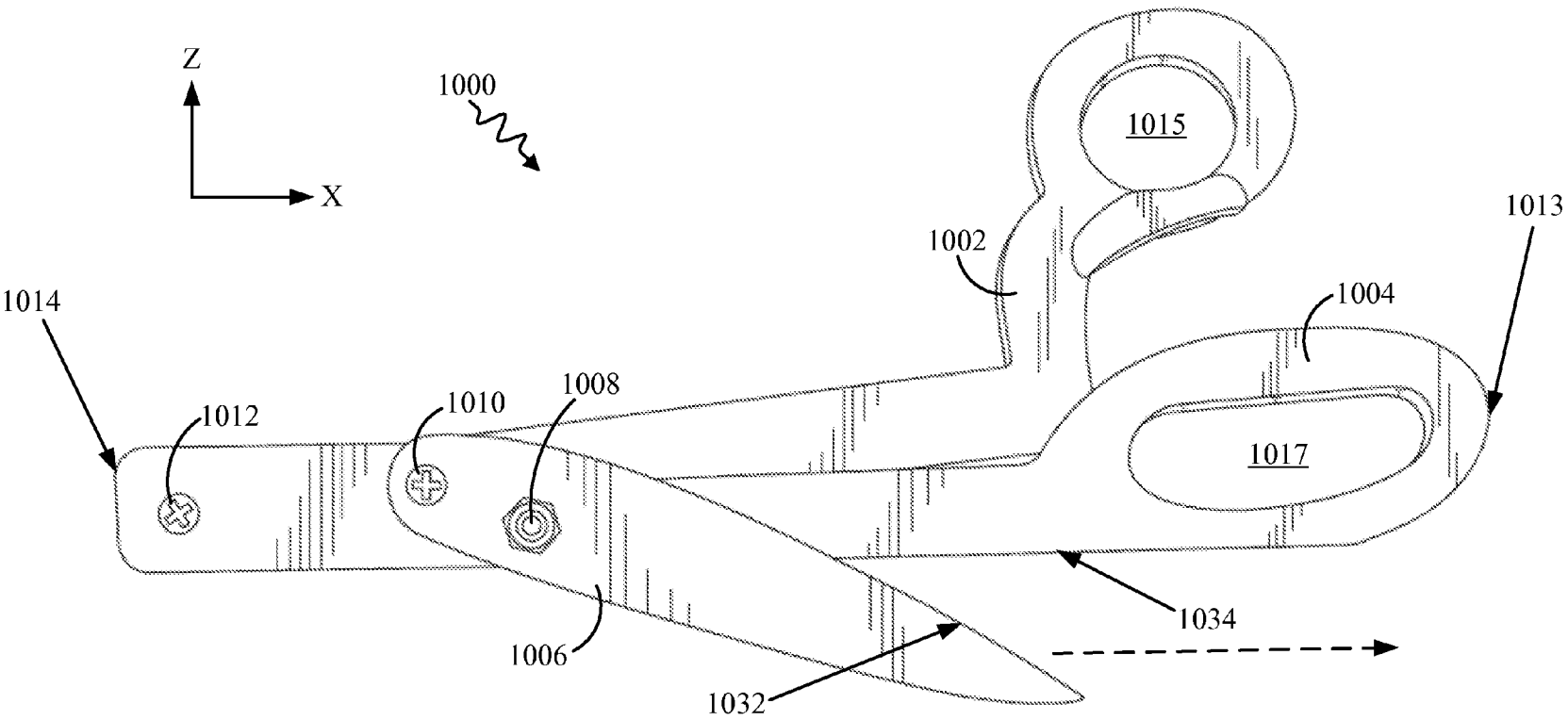
FIG. 10 illustrates a front-perspective view of a fourth embodiment of cutters.
Figure 11:
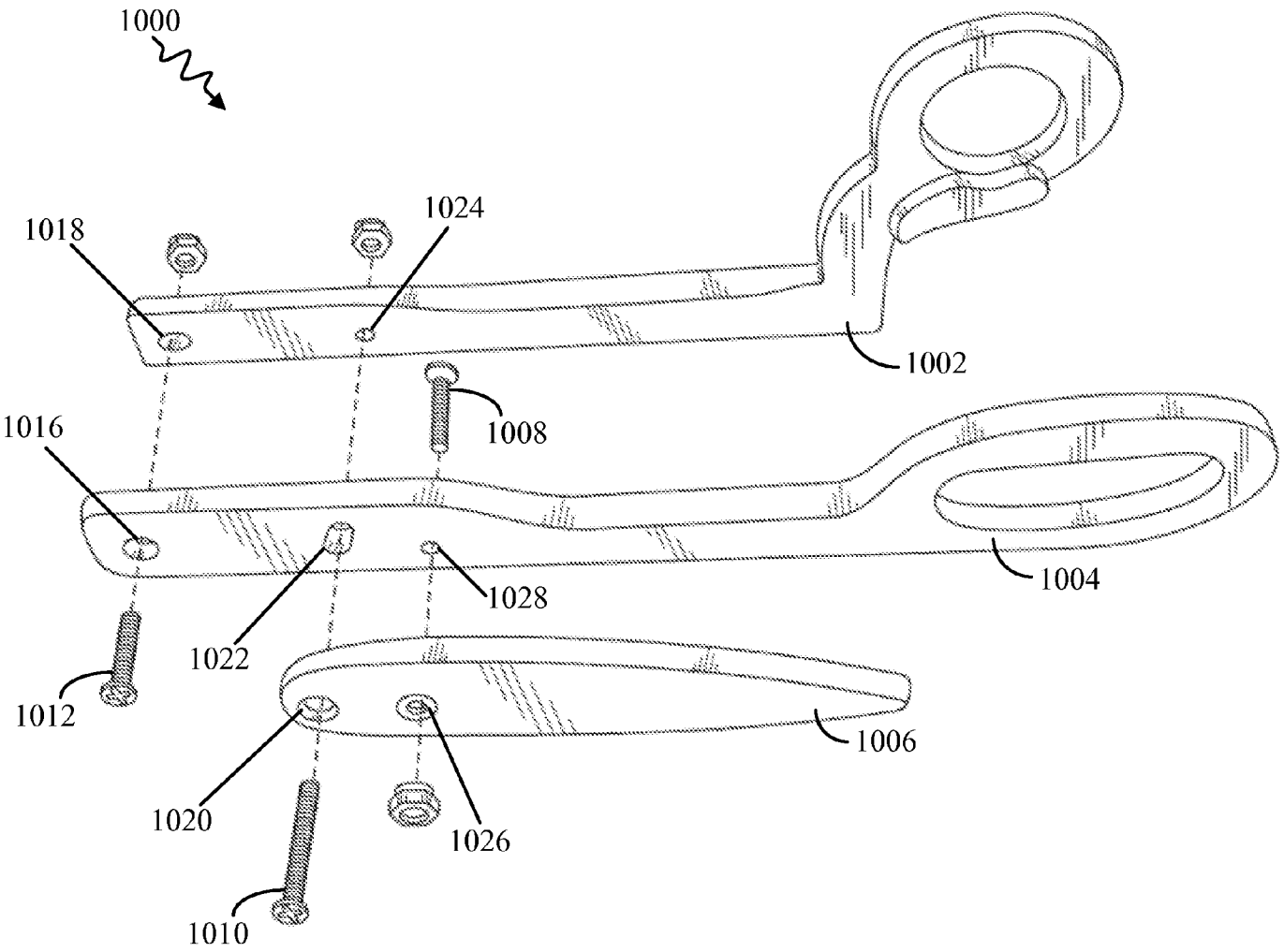
FIG. 11 illustrates a front, exploded view of the fourth embodiment of the cutters.
Figure 12:
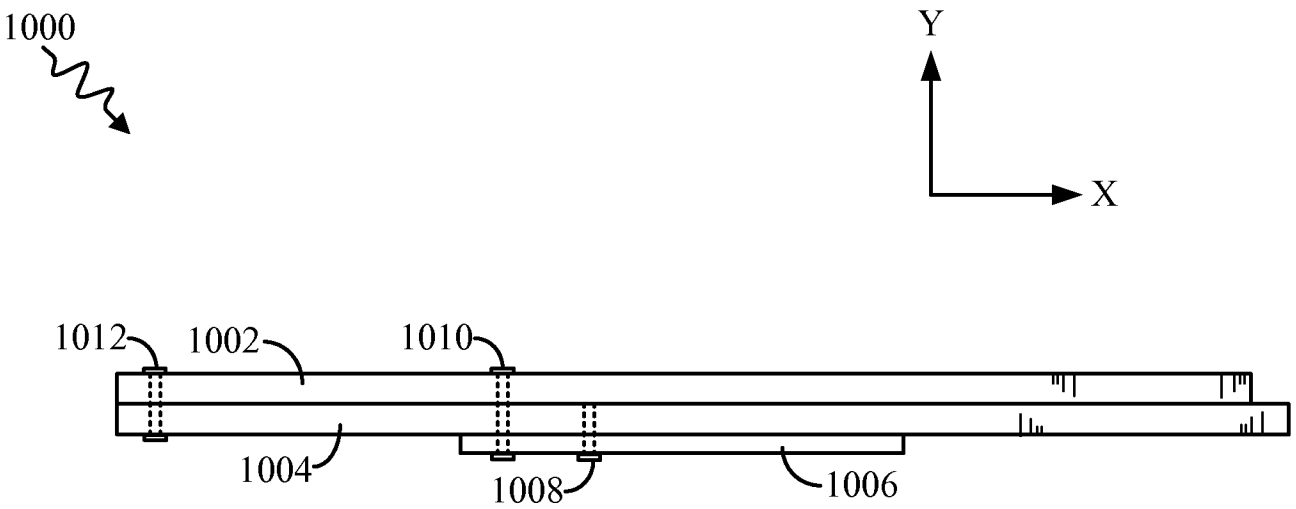
FIG. 12 illustrates a top view of the fourth embodiment of the cutters.

FIGS. 10-12 illustrate cutters 1000 according to a fourth embodiment of the disclosure. Specifically, FIG. 10 illustrates a front-perspective view of the cutters 1000. FIG. 11 illustrates a front, exploded view of the cutters 1000, and FIG. 12 illustrates a top view of the cutters 1000.

Referring to FIGS. 10, 11, and 12, the cutters 1000 may include a first lever 1002 (e.g., "top lever"), a second lever 1004 ("bottom lever"), a cutting lever 1006, a first member 1008 (e.g., "first pivot member" or "first pivot rod), a second member 1010 (e.g., "connector" or "second rod"), and a third member 1012 (e.g., "third pivot member" or "third pivot rod). The cutters 1000 are operated by moving the top lever 1002 and bottom lever 1004 toward and away from each other. A user may do that by placing one or more fingers in the finger holes 1015, 1017 of the top and bottom levers 1002, 1004 found near a first end 1013 of the cutters 1000 and spreading their fingers apart. Referring to FIG. 12, the cutters 1000 are horizontally-oriented cutters because the top and bottom levers 1002, 1004 are positioned adjacent to one another in the same horizontal plane (e.g., parallel to X-Y plane).

The third pivot rod 1012, located near a second end 1014 of the cutters 1000, passes through a hole 1016 in the bottom lever 1004 and then through a first slot 1018 (e.g., "first opening") located in the top lever 1002 thereby rotatably coupling the bottom lever 1004 and the top lever 1002 together. The first slot 1018 allows the top lever 1002 to slightly move around relative to the third pivot rod 1012 and the bottom lever 1004. According to one example, the first slot 1018 may instead be a circular hole having a diameter larger than third pivot rod 1012. The connector 1010 passes through a hole 1020 in the cutting lever 1006, a second slot 1022 (e.g., "second opening") located in the bottom lever 1004, and a hole 1024 in the top lever 1002. The connector 1010 rotatably couples the top lever 1002 and the cutting lever 1006 together. The connector 1010 moves about freely within the second slot 1022. The first pivot rod 1008 passes through a hole 1026 in the cutting lever 1006 and another hole 1028 in the lower lever 1004 thereby rotatably coupling the bottom lever 1004 and the cutting lever 1006 together. According to one embodiment, the second slot 1022 may have a curved shape like an arc having an inner side (e.g., intrados) that faces the second end 1014 of the cutters 1000. In other embodiments, the second slot 1022 may have another shape including, but not limited to, any elongated shape.

Opening the cutters 1000 by moving the top lever 1002 up and away from the lower lever 1004 causes the top lever 1002 to rotate (e.g., counterclockwise direction based on cutters' 1000 orientation in FIG. 10) about the third pivot rod 1012. It also causes the connector 1010 to move up within the second slot 1022, which in turn causes the cutting lever 1006 to rotate (e.g., clockwise direction based on orientation in FIG. 10) about the first pivot rod 1008. Rotating about the first pivot rod 1008 in this fashion moves the cutting lever's top edge 1032 away from the bottom lever's bottom edge 1034. According to one embodiment, the cutting lever's top edge 1032 and/or the bottom lever's bottom edge 1034 is sharpened in order to cut material positioned in between the cutting lever 1006 and the bottom lever 1004.

Closing the cutters 1000 by moving the top lever 1002 down and toward the lower lever 1004 causes the top lever 1002 to rotate (e.g., clockwise direction based on cutters' 1000 orientation in FIG. 10) about the third pivot rod 1012. It also causes the connector 1010 to move down within the second slot 1022, which in turn causes the cutting lever 1006 to rotate (e.g., counterclockwise direction based on orientation in FIG. 10) about the first pivot rod 1008. Rotating about the first pivot rod 1008 in this fashion moves the cutting lever's top edge 1032 toward the bottom lever's bottom edge 1034. As the cutters 1000 are closed, material located between the cutting lever 1006 and the bottom lever 1004 may be cut if the cutting lever's top edge 1032 and/or the bottom lever's bottom edge 1034 is sharp. The cutters 1000 may be pulled in the direction of the dashed arrow (see FIG. 10) while opening and closing the cutters 1000 as described above in order to cut additional material. The cutters 1000 may also be maneuvered in curved paths while operating the cutters 1000 (i.e., opening and closing the cutters 1000) to cut curved shapes of material. The material cut can vary widely but may include paper, cardboard, metal, wood, plastic, rubber, etc.

Fifth Embodiment

Figure 13:
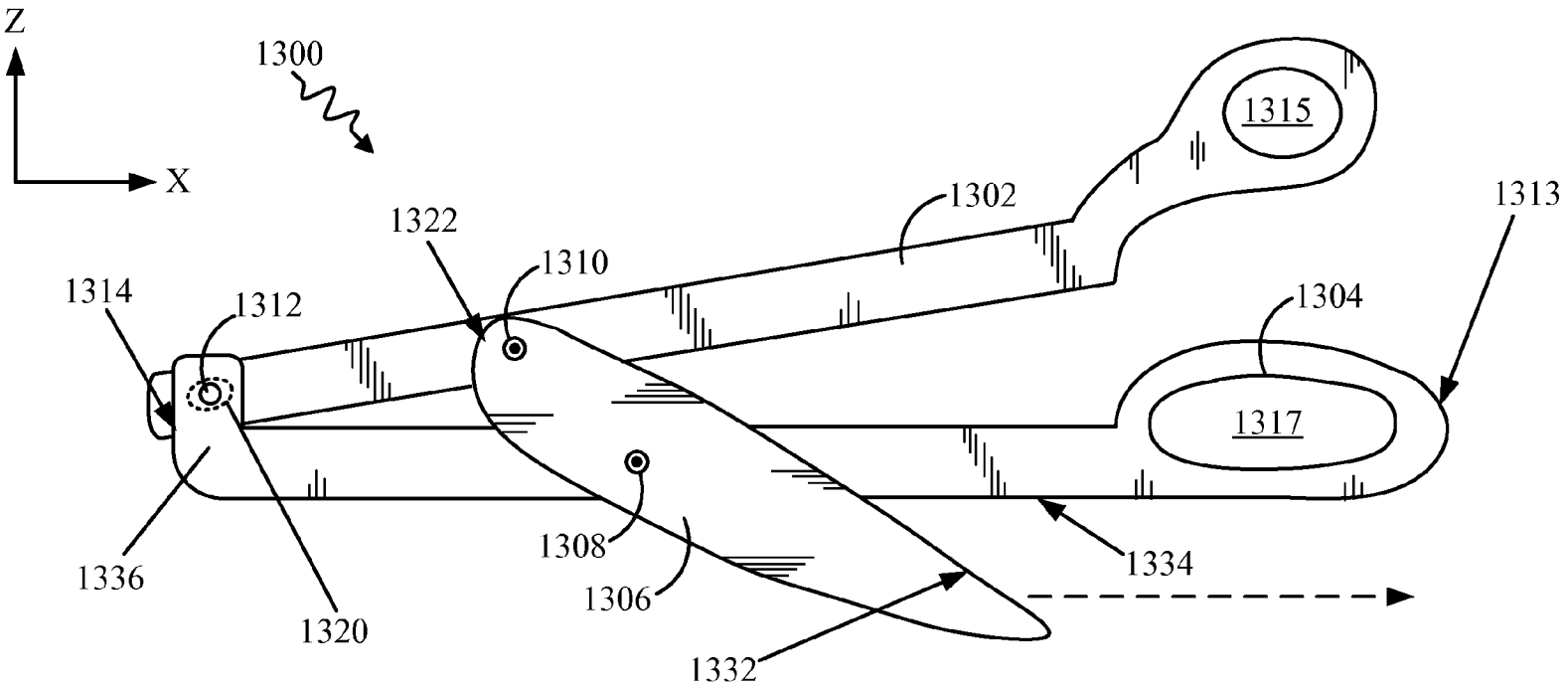
FIG. 13 illustrates a front view of a fifth embodiment of cutters.
Figure 14:
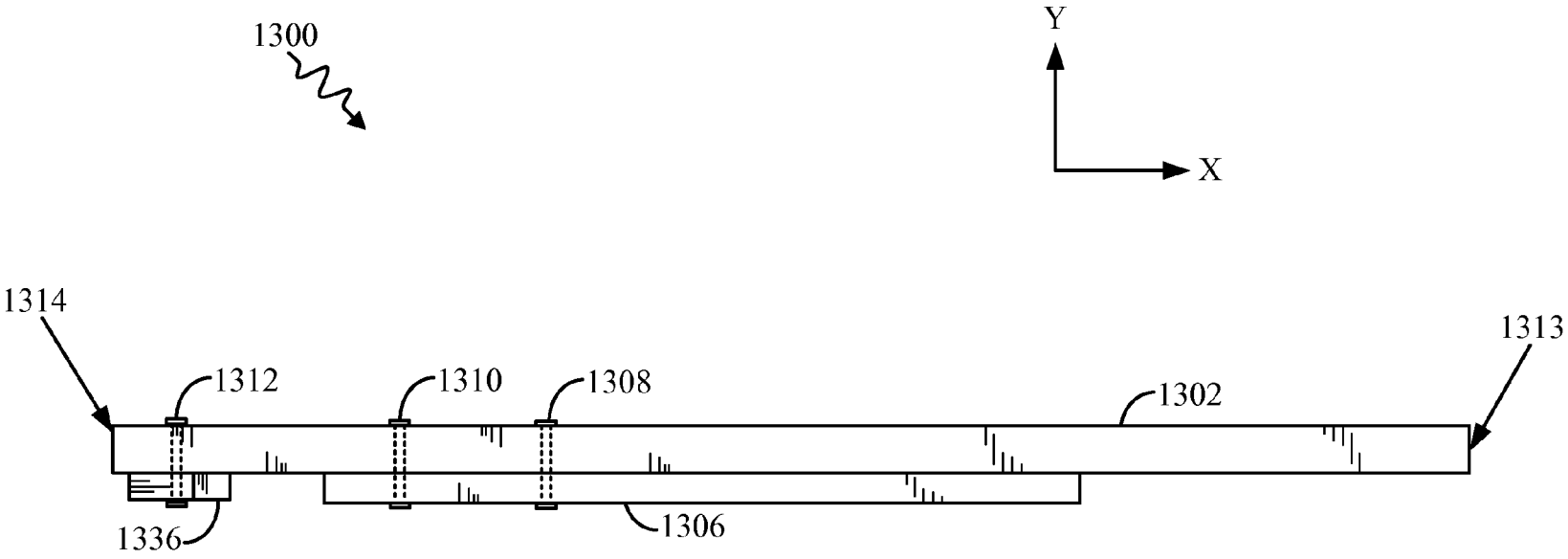
FIG. 14 illustrates a top view of the fifth embodiment of the cutters.
Figure 15:
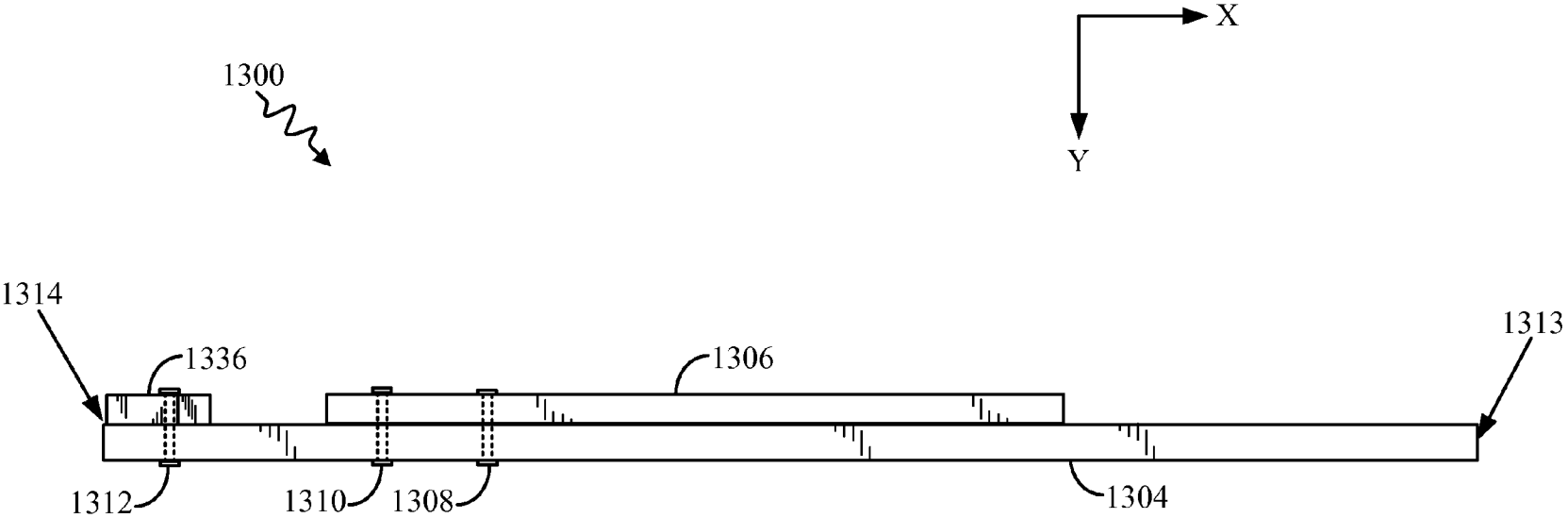
FIG. 15 illustrates a bottom view of the fifth embodiment of the cutters.

FIGS. 13-15 illustrate cutters 1300 according to a fifth embodiment of the disclosure. Specifically, FIG. 13 illustrates a front view of the cutters 1300, FIG. 14 illustrates a top view of the cutters 1300, and FIG. 15 illustrates a bottom view of the cutters 1300.

Referring to FIG. 13, the cutters 1300 may include a first lever 1302 (e.g., "top lever"), a second lever 1304 ("bottom lever"), a cutting lever 1306, a first pivot member 1308 (e.g., "first member" or "first pivot rod"), a second pivot member 1310 (e.g., "second member" or "second pivot rod"), a third pivot member 1312 (e.g., "third member" or "third pivot rod"), and a connecting piece 1336. The cutters 1300 are operated by moving the top lever 1302 and bottom lever 1304 toward and away from each other. A user may do that by placing one or more fingers in the finger holes 1315, 1317 of the top and bottom levers 1302, 1304 found near a first end 1313 of the cutters 1300 and spreading their fingers apart. Referring to FIGS. 13-15, the cutters 1300 may be considered "vertically-oriented cutters" in that the top and bottom levers 1302, 1304 are positioned in the same vertical plane (e.g., parallel to X-Z plane).

Referring to FIG. 13, the third pivot rod 1312, located near a second end 1314 of the cutters 1300, passes through a hole in the connecting piece 1336 and then through a first slot 1320 (e.g., "first opening") located in the top lever 1302, thereby rotatably coupling the top lever 1302 to the connecting piece 1336. Since the connecting piece 1336 is fixedly coupled to the bottom lever 1304, and in some embodiments it may actually be a part of the bottom lever 1304, the third pivot rod 1312 effectively rotatably couples the top lever 1302 to the bottom lever 1304. The first slot 1320 allows the top lever 1302 to move relative to the third pivot rod 1312 and the bottom lever 1304. The second pivot rod 1310 passes through a hole at about a first end 1322 of the cutting lever 1306 and also through a hole in the top lever 1302 thereby coupling the top lever 1302 and the first end 1322 of the cutting lever 1306 together. The first pivot rod 1308 passes through another hole in the cutting lever 1306 and also through a hole in the bottom lever 1304 thereby coupling the bottom lever 1304 and the cutting lever 1306 together. According to one embodiment, the first slot 1320 may instead be a circular hole and the hole in the top lever 1302 through which the second pivot rod 1310 passes through may instead be a slot (e.g., opening).

Opening the cutters 1300 by moving the top lever 1302 up and away from the lower lever 1304 causes the top lever 1302 to move relative to the third pivot rod 1312 and the bottom lever 1304 (e.g., for the orientation of the cutters 1300 shown in FIG. 13 the top lever 1302 slides in the direction of the dashed arrow). Opening the cutters 1300 also causes the top lever 1302 to pull the second pivot rod 1310 up and away from the bottom lever 1304, thereby causing the cutting lever 1306 to rotate (e.g., clockwise direction based on orientation shown in FIG. 13) about the first pivot rod 1308. Rotating about the first pivot rod 1308 in this fashion moves the cutting lever's top edge 1332 away from the bottom lever's bottom edge 1334. According to one embodiment, the cutting lever's top edge 1332 and/or the bottom lever's bottom edge 1334 is sharpened in order to cut material positioned in between the cutting lever 1306 and the bottom lever 1304.

Closing the cutters 1300 by moving the top lever 1302 down and toward the lower lever 1304 causes the top lever 1302 to move relative to the third pivot rod 1312 and the bottom lever 1304 in the opposite direction (e.g., for the orientation of the cutters 1300 shown in FIG. 13 the top lever 1302 slides in the opposite direction of the dashed arrow). This also causes the top lever 1302 to push the second pivot rod 1310 down and toward the bottom lever 1304, thereby causing the cutting lever 1306 to rotate (e.g., counterclockwise direction based on orientation shown in FIG. 13) about the first pivot rod 1308. Rotating about the first pivot rod 1308 in this fashion moves the cutting lever's top edge 1332 toward the bottom lever's bottom edge 1334. As the cutters 1300 are closed, material located between the cutting lever 1306 and the bottom lever 1304 may be cut if the cutting lever's top edge 1332 and/or the bottom lever's bottom edge 1334 is sharp. The cutters 1300 may be pulled in the direction of the dashed arrow while opening and closing the cutters 1300 as described above in order to cut additional material. The cutters 1300 may also be maneuvered in curved paths while operating the cutters 1300 (i.e., opening and closing the cutters 1000) to cut curved shapes of material. The material cut can vary widely but may include paper, cardboard, metal, wood, plastic, rubber, etc.

Sixth Embodiment

Figure 16:
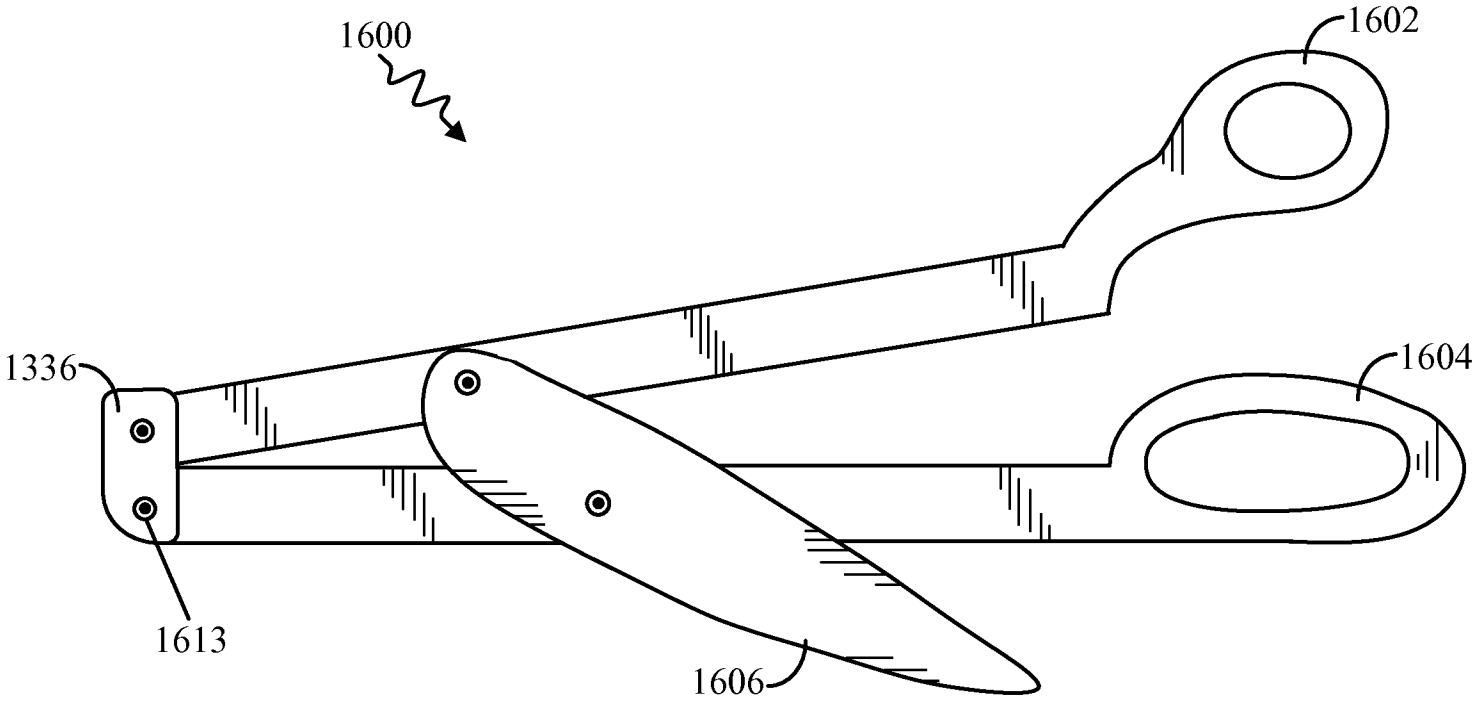
FIG. 16 illustrates cutters according to a sixth embodiment.

FIG. 16 illustrates cutters 1600 according to a sixth embodiment of the disclosure. Specifically, FIG. 16 illustrates a front view of the cutters 1600. The cutters 1600 shown in FIG. 16 is similar to the cutters 1300 shown in FIGS. 13-15 except that the cutters 1600 shown in FIG. 16 includes a fourth pivot rod (e.g., "fourth member" or "fourth pivot member") 1613 that passes through a another hole in the connecting piece and through a hole in the cutters' bottom lever 1604. This allows the connecting piece 1336 to rotatably couple with respect to the bottom lever 1604 instead of being fixedly coupled to the bottom lever 1604. The top lever 1602 of the cutters 1600 shown in FIG. 16 also does not have or need a first slot 1320 and may be instead replaced by a circular shaped hole.

Other Embodiments

Figure 17:
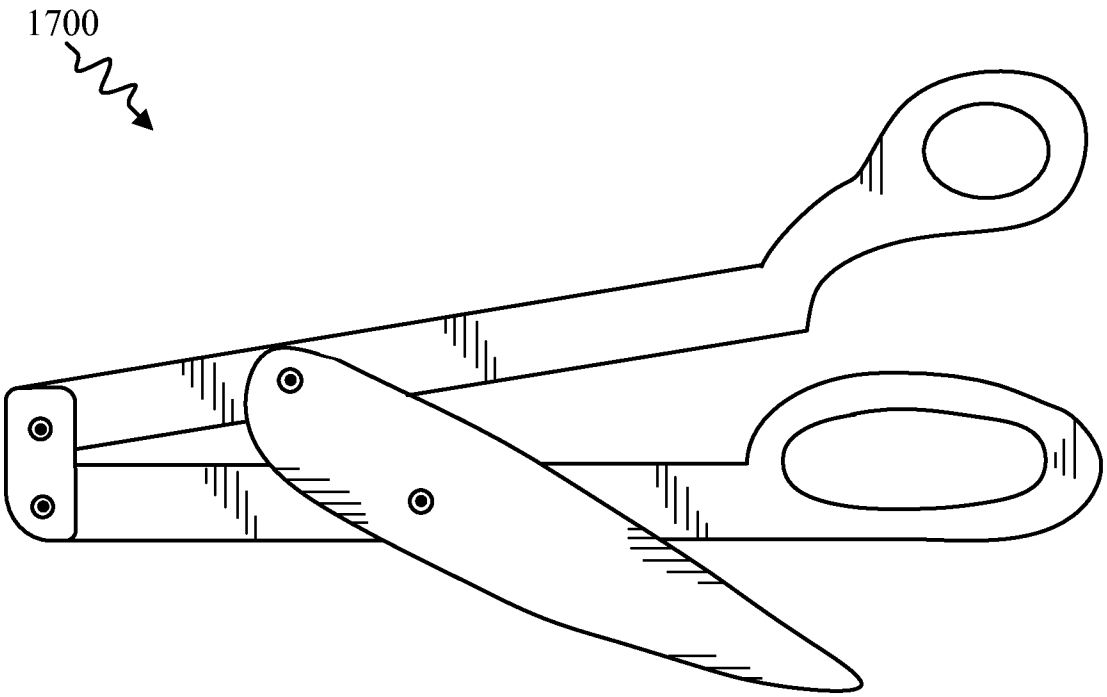
FIG. 17 illustrates exemplary cutters that can be shortened and made more compact.

FIG. 17 illustrates how one or more of the cutters 100, 600, 800, 1000, 1300, 1600 described herein can be shortened and made more compact. In the illustrated example, the cutters 1700 are a compact version of the cutters 1600 shown in FIG. 16. Similarly, cutters 100, 600, 800, 1000, 1300, 1600 described herein can be made significantly larger so that two hands are needed for operation.

Figure 18:
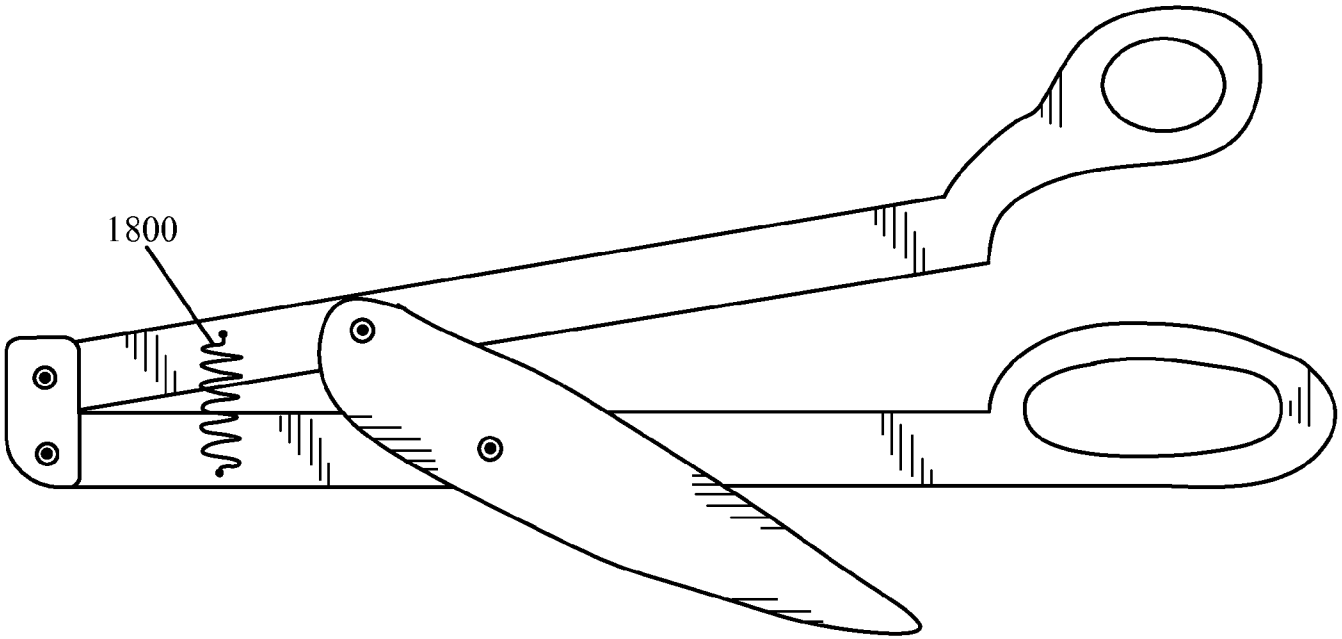
FIG. 18 illustrates exemplary cutters modified with a spring that adds force when cutting material.

FIG. 18 illustrates how one or more of the cutters 100, 600, 800, 1000, 1300, 1600 described herein can be modified with a spring 1800 in order to add force when cutting material.

Figure 19:
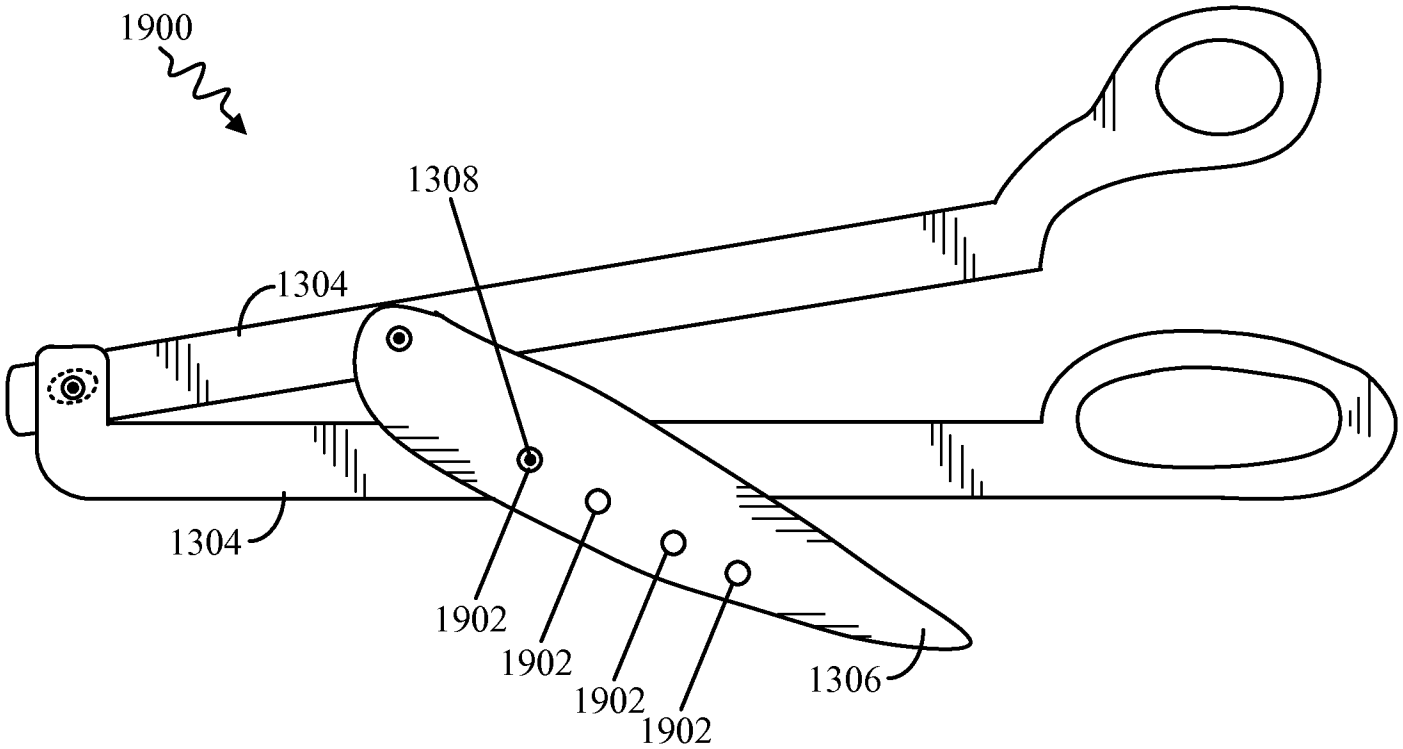
FIG. 19 illustrates first exemplary cutters having adjustable leverage.

FIG. 19 illustrates how the cutters 1300 shown and described with respect to FIGS. 13-15 can be modified to have adjustable leverage. Specifically, the cutting lever 1306 and the bottom lever 1304 may be modified to include a plurality of pivot holes 1902 where the first pivot rod 1308 may be moved from one pivot hole 1902 to another 1902 to change the leverage supplied by the cutters 1900. The cutters 100, 1600 shown in FIGS. 1 and 16 may similarly be modified.

Figure 20:
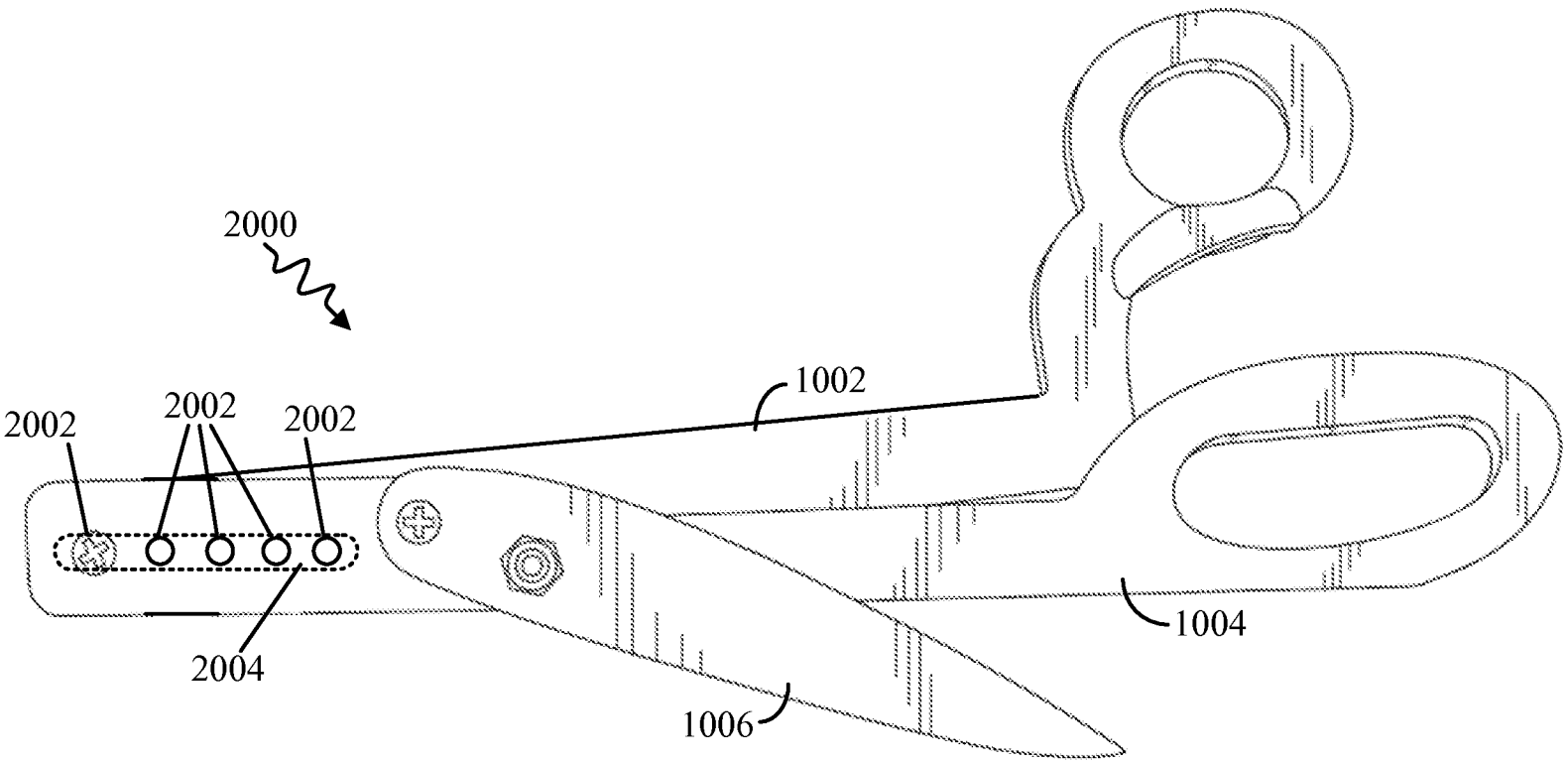
FIG. 20 illustrates second exemplary cutters having adjustable leverage.

FIG. 20 illustrates how the cutters 1000 shown and described with respect to FIGS. 10-12 can be modified to have adjustable leverage. Specifically, the bottom lever 1004 may be modified by adding a plurality of pivot holes 2002 as shown. The top lever 1002 may be modified to include an elongated opening 2004 (e.g., slot). The third pivot rod 1012 may then be moved to different pivot holes 2002 to change the leverage supplied by the cutters 2000. The cutters 100 shown in FIG. 1 may similarly be modified.

One or more of the components, steps, features, and/or functions illustrated in FIGS. 1, 2, 3, 4, 5, 6, 7, 8, 9, 10, 11, 12, 13, 14, 15, 16, 17, 18, 19, and/or 20 may be rearranged and/or combined into a single component, step, feature or function or embodied in several components, steps, or functions. Additional elements, components, steps, and/or functions may also be added without departing from the invention.

The various features of the invention described herein can be implemented in different systems without departing from the invention. It should be noted that the foregoing embodiments of the disclosure are merely examples and are not to be construed as limiting the invention. The description of the embodiments of the present disclosure is intended to be illustrative, and not to limit the scope of the claims. As such, the present teachings can be readily applied to other types of apparatuses and many alternatives, modifications.

What is claimed is:

1. An apparatus comprising:

a top lever having a first end that includes a first handle;

a bottom lever having a first end that includes a second handle, the bottom lever including a bottom edge;

a cutting lever having a top edge, at least one of the bottom edge and/or the top edge being sharp;

a first member rotatably coupling the cutting lever to the bottom lever; and a second member coupling the top lever to the cutting lever by passing through the bottom lever, the top lever adapted to move the second member when the first handle is moved relative to the second handle, moving the second member causes the cutting lever to rotate about the first member to move the top edge toward or away from the bottom edge, and wherein the top edge extends from the first member in a substantially same direction as the first and second handles.

2. The apparatus of claim 1, wherein an opening in the bottom lever allows the second member coupling the top lever to the cutting lever to pass through the bottom lever, and the top lever is adapted to move the second member within the opening.

3. The apparatus of claim 1, wherein the first member is positioned closer to the first and second handles than the second member.

4. The apparatus of claim 3, wherein an opening in the bottom lever allows the second member coupling the top lever to the cutting lever to pass through the bottom lever, and raising the top lever up and away from the bottom lever causes the second member to move up within the opening in a same direction as the top lever.

5. The apparatus of claim 4, further comprising:

a third member rotatably coupling the top lever to the bottom lever, the third member positioned further away from the first and second handles than both the first member and the second member.

6. The apparatus of claim 1, wherein the second member is positioned closer to the first and second handles than the first member.

7. The apparatus of claim 6, wherein an opening in the bottom lever allows the second member coupling the top lever to the cutting lever to pass through the bottom lever, and raising the top lever up and away from the bottom lever causes the second member to move down within the opening in an opposite direction as the top lever.

8. The apparatus of claim 7, further comprising:

a third member rotatably coupling the top lever to the bottom lever, the third member positioned closer to the first and second handles than both the first member and the second member.

9. The apparatus of claim 1, wherein at least one of the first and second members is at least one of a rod, screw, or a rivet.

10. The apparatus of claim 1, wherein the top lever is adapted to move within a first vertical plane that is different than a second vertical plane that the bottom lever is adapted to move within, the top lever and the bottom lever positioned adjacent to each other.

11. The apparatus of claim 1, wherein the bottom lever is positioned in between the top lever and the cutting lever.

12. The apparatus of claim 1, wherein a slot in the bottom lever allows the second member coupling the top lever to the cutting lever to pass through the bottom lever.

13. The apparatus of claim 1, wherein the top edge and the bottom edge define a cutting region having an open end when the apparatus is placed in an open position, the open end adapted to receive sheet material to be cut.

14. The apparatus of claim 1, wherein the cutting lever is adapted to rotate about the first member to such a degree that the top edge and bottom edge meet placing the apparatus in a closed position.

15. The apparatus of claim 1, further comprising:

a third member rotatably coupling the top lever to the bottom lever, and at least one of the top lever and/or the bottom lever includes a plurality of holes to which the third member is adapted to pass through to adjust leverage of the apparatus.

16. An apparatus comprising:

a top lever having a first handle;

a bottom lever having a second handle, the bottom lever including a bottom edge;

a cutting lever having a top edge;

a means for coupling the cutting lever to the bottom lever, the means for coupling the cutting lever to the bottom lever adapted to allow the cutting lever to rotate relative to the bottom lever, the top edge and the bottom edge extending from the means for coupling the cutting lever to the bottom lever in a substantially same direction as the first and second handles; and a means for coupling the top lever to the cutting lever that passes through the bottom lever, the top lever adapted to move the means for coupling the top lever to the cutting lever when the first handle is moved relative to the second handle, and wherein movement of the means for coupling the top lever to the cutting lever causes the cutting lever to rotate about the means for coupling the cutting lever to the bottom lever.

17. The apparatus of claim 16, wherein the bottom lever is positioned in between the top lever and the cutting lever, and the means for coupling the top lever to the cutting lever passes through a slot of the bottom lever to couple the top lever to the cutting lever.

18. An apparatus comprising:

a top lever having a first handle;

a bottom lever having a second handle, the bottom lever including a bottom edge;

a cutting lever having a top edge;

a pivot member rotatably coupling the cutting lever to the bottom lever; and a connector coupling the top lever to the cutting lever by passing through the bottom lever, the top lever adapted to move the connector when the first handle is moved relative to the second handle, moving the connector causes the cutting lever to rotate about the pivot member to move the top edge toward or away the bottom edge, and the top edge and the bottom edge extend from the pivot member in a substantially same direction as the first and second handles.

19. The apparatus of claim 18, wherein the top edge and the bottom edge define a cutting region having an open end when the apparatus is placed in an open position, the open end adapted to receive sheet material to be cut.

20. The apparatus of claim 18, wherein the cutting lever is adapted to rotate about the pivot member to such a degree that the top edge and bottom edge meet placing the apparatus in a closed position.

* * * * *